US005305850A

United States Patent [19]

McQuiston

[11] Patent Number: 5,305,850

[45] Date of Patent: Apr. 26, 1994

[54] KNOCK-DOWN SAWHORSE

[76] Inventor: Arthur J. McQuiston, 8411 NE. 54th St., Unit D2, Vancouver, Wash. 98662

[21] Appl. No.: 81,784

[22] Filed: Jun. 22, 1993

[51] Int. Cl.[5] ..... B27B 21/00

[52] U.S. Cl. ..... 182/153; 182/226; 182/151; 182/181

[58] Field of Search ..... 182/181–186, 182/224–227, 153–155, 151; 248/164

[56] References Cited

U.S. PATENT DOCUMENTS

| | | | |
|---|---|---|---|
| D. 152,821 | 2/1949 | O'Neil | D34/5 |
| D. 245,105 | 7/1977 | Rader | D25/67 |
| 1,749,190 | 3/1930 | McGregor | 182/186 X |
| 1,982,061 | 11/1934 | Marlowe | 182/186 |
| 2,261,217 | 11/1941 | Bond | 182/226 |
| 2,911,265 | 11/1959 | Hannah | 182/181 |
| 3,035,660 | 5/1962 | Leon | 182/181 |
| 4,071,113 | 11/1978 | Pelser | 182/181 |
| 4,574,917 | 3/1986 | Stoddard | 182/151 |
| 4,638,885 | 1/1987 | Frederick | 182/151 |
| 4,883,246 | 11/1989 | Esposito | 248/165 |
| 4,890,693 | 1/1990 | O'Brien | 182/151 |
| 5,052,308 | 10/1991 | Brown | 2118/164 X |

OTHER PUBLICATIONS

Six photographs of a metal clamp sawhorse as referred to in the specification on pp. 2–3.

*Primary Examiner*—Alvin C. Chin-Shue

*Attorney, Agent, or Firm*—Marger, Johnson, McCollom & Stolowitz

[57] ABSTRACT

The invention is a sawhorse that is quickly assembled and disassembled and is strong enough to support a heavy load. The sawhorse includes an elongated, horizontally disposed, rectilinear support member held above the ground by two spaced pairs of oppositely inclining leg members that overlap at a top end. Each leg member has a rectangular notch at the top end that is acutely angled to form a channel that receives the support member. A lower portion of the support member has two space rectangular channels for receiving the top ends of each pair of leg members. The leg members are pivotally coupled together with a pivot screw so that each leg member can be quickly rotated into a receiving position where the notches are aligned and able to receive the support member. Each leg member has the same dimensions and has a notch that is the same size and located at the same relative location making the sawhorse quick and inexpensive to fabricate.

13 Claims, 4 Drawing Sheets

KNOCK-DOWN SAWHORSE

BACKGROUND OF THE INVENTION

This invention relates generally to a portable apparatus for supporting various objects horizontally above the ground and more particularly to a knock-down sawhorse that can be quickly assembled and disassembled.

Sawhorses are typically used on construction sites as temporary structures to provide a horizontal support surface for holding equipment and materials. For example, the sawhorse holds lumber and sheetrock above the ground so that it can be easily cut. Sawhorses are used as support structures in a wide variety of applications for permanently or temporarily holding articles above the ground or floor. For example, sawhorses are used to hold up displays at conventions or can be used as table legs for a temporary student desk.

Since sawhorses are typically used on a temporary basis at any one location, it is important that they can be quickly disassembled (i.e., knocked down) for easy storage and transport to alternative locations. A standard sawhorse includes a horizontal support member, such as a 2×4 inch board, permanently nailed at each end to a pair of legs formed by oppositely inclined boards that extend from the sides of the support member. The assembled sawhorse is ungainly and, since the pieces of the sawhorse are nailed together, it cannot be easily disassembled. Thus, the sawhorse cannot be easily transported, for example, in a car to different locations.

To allow easy transport and storage, various types of knock down support structures have been developed. For example, U.S. Pat. No. 3,035,660 to Leon and U.S. Pat. No. 4,574,917 to Stoddard show knock-down support stands that have legs that extend laterally out from ends of a horizontal support member. However, to sufficiently balance the ends of the support member, each leg is specially cut in a triangular pattern from a wide sheet of wood. The wide pieces of wood used for each leg of the support structure are expensive and take more time to cut than the 3 to 6 inch wide boards commonly used in standard sawhorse legs. In addition, wider pieces of wood are typically thinner and, therefore, cannot support as much weight as a standard sawhorse.

U.S. Pat. No. 4,638,885 to Frederick and U.S. Pat. No. 4,890,693 to O'Brian show knock-down sawhorses that have legs that use standard board sizes. However, the sawhorses in Frederick and O'Brian require additional fasteners to attach the legs to the horizontal support members. Additional fasteners, whether made out of wood or metal, increase manufacturing costs and increase assembly time. In addition, it is easier to misplace or lose pieces of the sawhorse which would prevent it from being properly assembled.

Alternative sawhorse configurations use metal clamps that bite into a horizontal support member. Two oppositely inclining boards are nailed into receiving slots at the bottom end of the clamp to form legs. Each clamp has a spring that is compressed by pressing the two legs together. In the compressed state, the claws separate allowing insertion of the support member. By allowing the spring to decompress, the claws clamp onto opposite sides of the support member and the legs move back into an inclined position. Alternatively, if there is no spring, the clamp is held against opposite sides of the support member by holding the legs out in the inclined position. The legs are held in the inclined position by nailing a board across the two leg members.

The metal claws used for this type of sawhorse are expensive and increase the number of components required to assemble the sawhorse. Since the claws and the claw spring are made of metal, they can also rust to the point where they no longer operate correctly. In addition, it is possible that someone cutting wood on the sawhorse can accidentally run over one of the metal claws destroying a saw blade. Since the legs of the sawhorse are nailed to the metal clamp, it is difficult to completely disassemble the sawhorse into easy transportable components.

Accordingly, a need remains for a simple, low cost sawhorse that can support heavy loads and can be quickly assembled and disassembled.

SUMMARY OF THE INVENTION

It is, therefore, an object of the invention to reduce the cost of manufacturing a knock-down sawhorse.

Another object of the invention is to reduce the time required to assemble and disassemble a sawhorse.

A further object of the invention is to reduce the number of components used in a knock-down sawhorse while maintaining a high load strength.

The invention is a knock-down sawhorse that supports various articles above the ground on an elongated, horizontally disposed, support member supported at spaced-apart lengthwise positions by a pair of detachable leg assemblies. Each leg assembly includes a pair of oppositely inclining leg members that overlap at a top end. Each pair of leg members has a notch at a top end that is aligned to form a channel that receives the support member. The notches are formed at an angle to the leg's longitudinal axis allowing the legs to incline at a given angle.

The support member preferably includes a pair of grooves that engage with the leg assembly channels. The grooves are directed downward along a bottom side of the support member passing symmetrically through the first and second sides of the support member at oppositely inclining angles. The grooves have parallel inside faces that provide lateral support for holding the two legs together.

Each leg assembly includes an optional pivot screw that pivotally couples the leg members together. The pivot screw allows the leg members to quickly rotate into a receiving position where the notches are aligned and able to receive the support member. The pivot screw is attached underneath the leg member notch so that the support member, after being inserted into the leg assembly channel, sits over the pivot screw.

In one embodiment of the sawhorse, the leg members and the top support member are made from standard size wood boards. The invention provides high load strength (i.e., can support a heavy load) since the sides of each leg member are perpendicular with the sides of the support member. This allows a notch to be cut in the center end of each leg member surrounded by a maximum amount of wood.

The angles at which the leg members extend down away from the support member are easily altered by changing the cutting angle for the top and bottom ends of each leg member. Thus, the notch of each leg member, which is cut at an angle perpendicular with the top end, accordingly control how wide the leg members spread out underneath the support member.

Since each leg member has the same dimensions and has a notch that is the same size and located at the same relative location, it is quick and inexpensive to fabricate the sawhorse according to the invention. For example, two leg members can be made at the same time by lying two boards on top of each other and cutting the top and bottom ends at the same angle. Then, while still lying on top of each other, notches can be cut at the top end of each board in the same location.

The sawhorse is also very easy to assemble and disassemble. For example, after the two leg members and the support member are cut, a first leg is inverted 180 degrees. The first leg member is overlapped at the top end with the second leg member until the notches of the two legs align forming a single channel. The support member is then simply inserted into the channel holding the two leg members securely in place. The sawhorse is disassembled by simply pulling the support member out from between the leg assembly channel. Since the leg members and the support member comprise relatively narrow boards, they can be easily placed on top of each other for easy transport and storage.

Thus, the sawhorse is easy to fabricate, quickly assembled and disassembled, and is strong enough to support a heavy load. While effective in supporting heavy loads, due to the lightweight and easy assembly and disassembly procedure, the sawhorse according to the invention is also ideal for use as a barricade or alternative temporary support structure.

The foregoing and other objects, features and advantages of the invention will become more readily apparent from the following detailed description of a preferred embodiment of the invention which proceeds with reference to the accompanying drawings.

DETAILED DESCRIPTION

Figure 1:
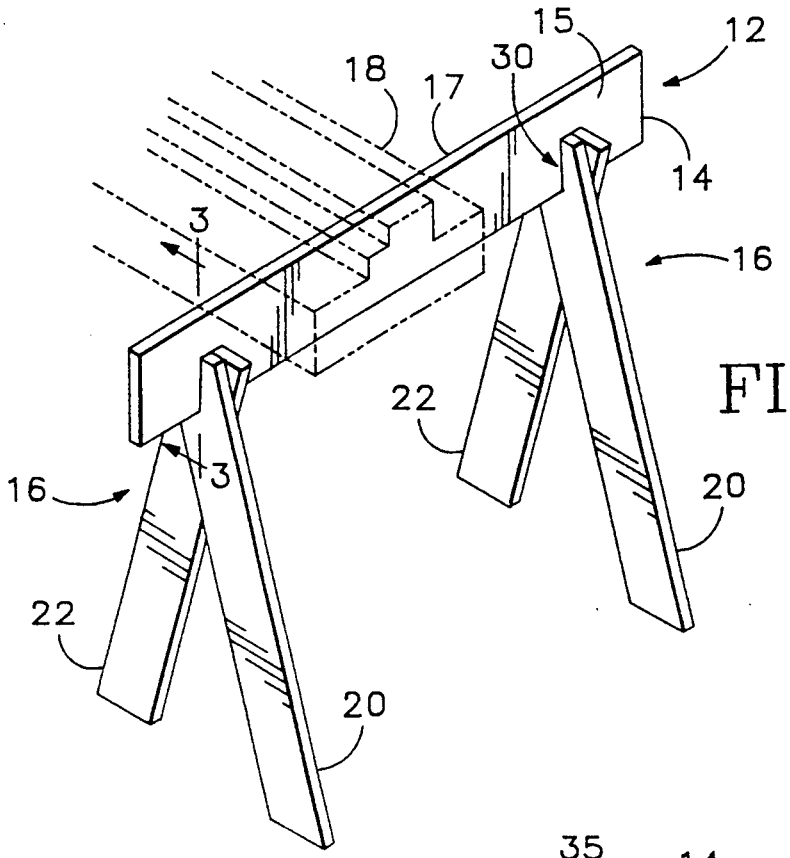
FIG. 1 is a perspective view of a knock-down sawhorse according to the invention in a fully assembled position.

FIG. 1 is perspective view of a knock-down sawhorse 12 according to the invention in a fully assembled position. The sawhorse includes a horizontal support member 14 supported above the ground by a pair of leg assemblies 16. Each leg assembly includes two leg members 20 and 22. Each leg member has a notch 24 at a top end that engages with the support member 14 as will be discussed in detail below. A load 18 is shown in phantom lines resting on the top of support member 14.

Figure 2:
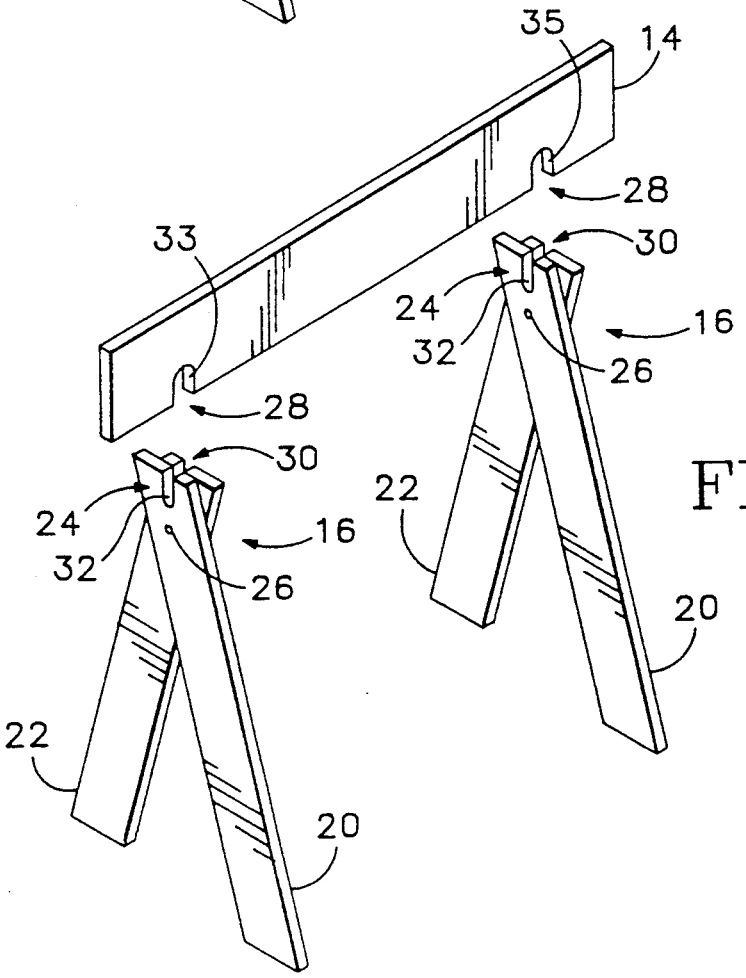
FIG. 2 is a perspective view of the sawhorse shown in FIG. 1 with the support member removed from the leg assemblies.

FIG. 2 is a perspective view of the sawhorse 12 shown in FIG. 1 with the support member 14 removed from the leg assemblies 16. The support member 14 has two grooves 28 located on opposite longitudinal ends. The leg members 20 and 22 each have a notch 24 at the top end that align to form a channel 30 for receiving the support member 14. The legs 20 and 22 of each leg assembly 16 are pivotally coupled together by a pivot screw 26.

To assemble the sawhorse, the leg members 20 and 22 are first rotated about the pivot screw 26 until the notches 24 at the top end align to form the channel 30. Each support member groove 28 is then inserted into one of the leg assembly channels 30. In the inserted position, the support member is held vertically upward by the inside walls 32 of the leg assembly channel 30. At the same time, the support member 14 locks the leg members 20 and 22 in oppositely opposed inclining positions as shown in FIG. 2.

The inside walls 35 of grooves 28 in support member 14 press against opposite sides of the leg assembly 16, providing lateral support. Thus, by inserting the support member 14 into the leg assembly channel 30, the leg assembly 16 is held upright in the inverted "V" position shown in FIG. 2.

The pivot screws 26 serve several useful functions. First, the pivot screws make it easier to align the notches 24 in leg members 20 and 22. For example, the leg members 20 and 22 simply have to be rotated about pivot screw 26 until notches 24 align to form channel 30. Thus, less time is required to properly align the leg assembly 16 into the support member receiving position shown in FIG. 2. Second, the pivot screws keep the leg members 20 and 22 attached preventing misplacement of a leg member. It is important to note, however, that the sawhorse can still operate properly without pivot screw 26. For example, each leg member can be inserted into groove 28 separately. Additionally, the pivot screws help bindingly engage the support member in notches 24.

Figure 3:
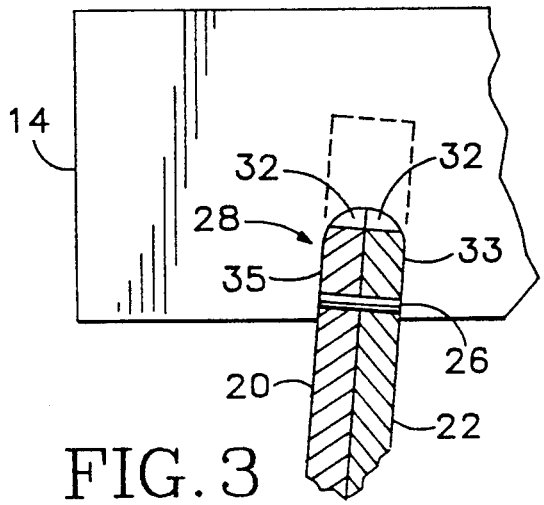
FIG. 3 is a partial side-sectional view of the leg assembly shown in FIG. 2.

FIG. 3 is a partial cross-sectional view of the leg assembly 16 shown in FIG. 2. The two leg members 20 and 22 engage with support member 14 pressing snugly against the parallel inner walls 33 and 35 of groove 28. The support member 14 correspondingly engages with leg assembly channel 30 (FIG. 2) passing over pivot screw 26. The opposite inside walls 32 of notch 24 in leg members 20 and 22 press against opposite sides of support member 14.

Referring back to FIG. 1, a load 18 that applies pressure vertically downward on support member 14 serves to increase the stability of sawhorse 12. For example, as more weight is placed on support member 14, the inside wall 32 (FIG. 2) of notch 24 in leg member 20 presses harder against the front side 15 of support member 14. Correspondingly, the inside wall 32 of notch 24 in leg member 22 presses harder against the back side 17 of support member 14. Thus, each leg assembly 16 clamps harder onto the support member 14 as the weight of load 18 is increased. Thus, sawhorse 12 becomes more stable as more weight is applied to the top of support member 14. Alternatively, when load 18 is removed, the pressure at which leg assemblies 16 clamp to support member 14 decreases. Thus, support member 14 is easily removed from the leg assembly channel 30 (FIG. 2).

Figure 4:
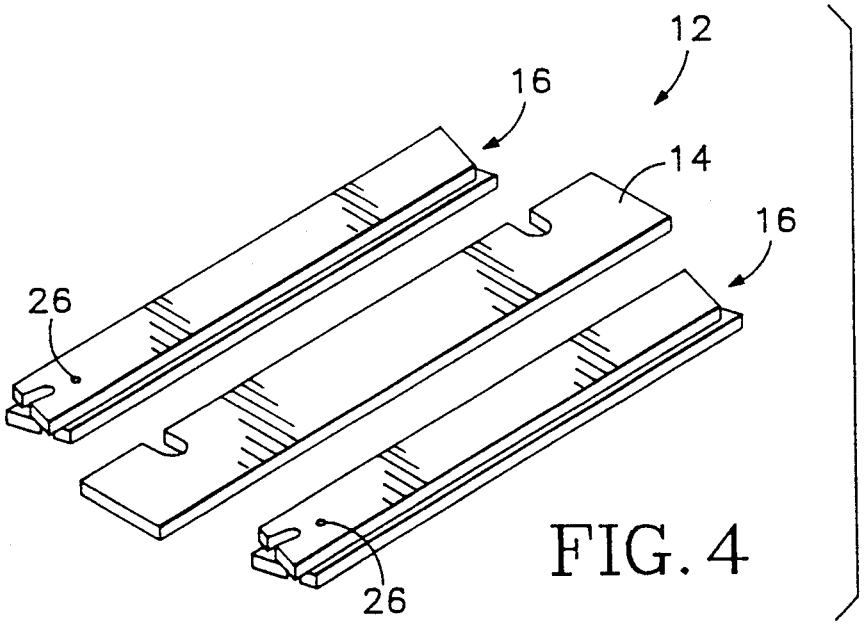
FIG. 4 is a perspective view of the sawhorse shown in FIG. 1 in a fully disassembled position.

FIG. 4 is a perspective view of the sawhorse shown in FIG. 1 in a fully disassembled position. The leg assemblies 16 can be folded into a closed position as shown in FIG. 4 for easy transport and storage. The added capacity to fold the leg assemblies 16 increase the utility of the invention over standard sawhorses. Standard sawhorses have single unitary leg assemblies which require more space to transport and store. However, the separate support member 14, and separate movable leg members 20 and 22 are broken down into separate sections no wider than only one single board. Thus, the sawhorse can be stored and locked into relatively small spaces, for example, behind the front seat of a pickup truck.

Figure 5:
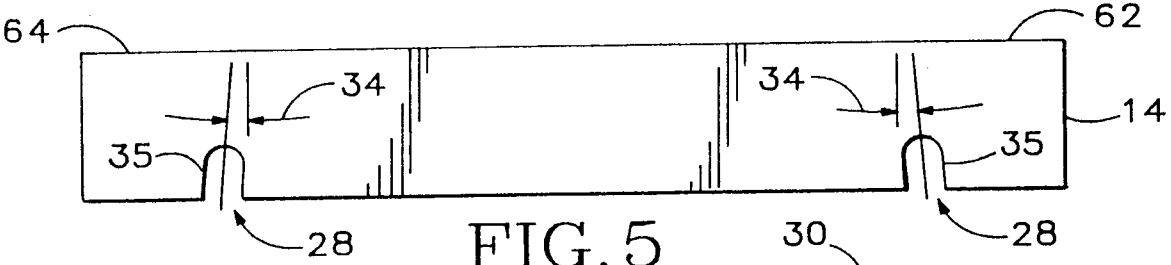
FIG. 5 is an enlarged front view of the support member shown in FIG. 1.

FIG. 5 is a enlarged front view of the support member 14 shown in FIG. 1. The grooves 28 are located at opposite ends of the support member 14 and are cut at oppositely inclining angles 34. The angles 34 cause the leg assemblies 16 (FIG. 1) to incline slightly away from the longitudinal ends 62 and 64 of the support member 14. The incline of the leg assemblies, created by angle 34 in groove 28, allow the inside wall 35 of groove 28 to press firmly against the side of the leg assembly 16. In addition, the opposite inclining angles of the two leg assemblies create a larger base for the sawhorse further increasing stability.

In one embodiment of the invention, the support member is a wood board approximately 36 inches long, 5½ inches wide, and ¾ inches thick. In this embodiment, the grooves 28 are cut approximately 2 inches deep, 1½ inches wide, and at angles 34 of approximately 5 degrees. The width of groove 28 can be altered according to the thickness of leg members 20 and 22. In principle, groove 28 should be sized to slidingly receive and snugly engage the support member.

Figure 6:
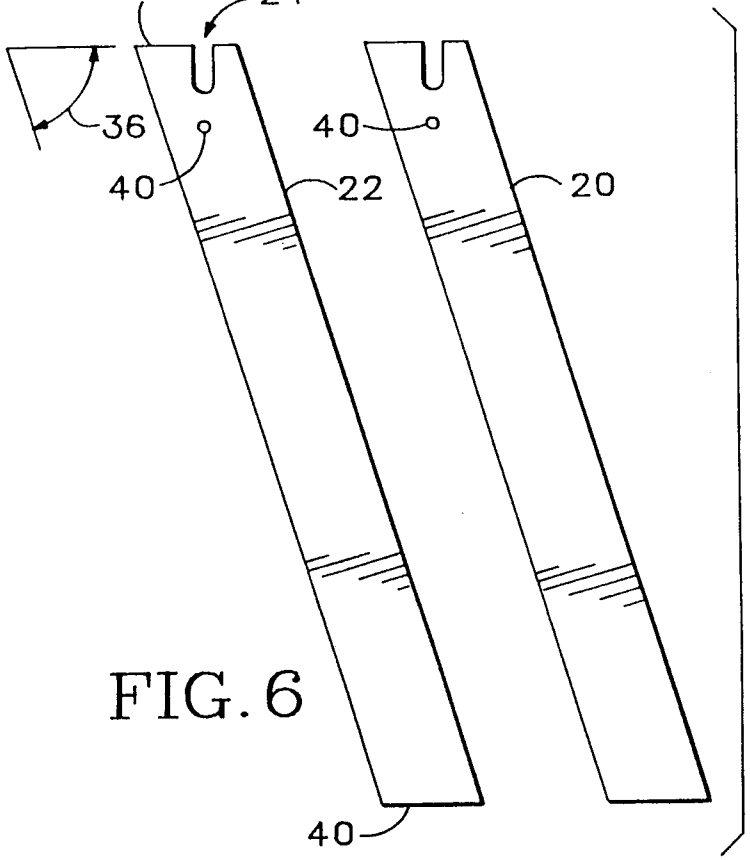
FIG. 6 is an enlarged front view of the leg members shown FIG. 1.

FIG. 6 is an enlarged front view of the leg members 20 and 22 shown in FIG. 1. Each leg member has the same dimensions. For example, the top end 38 and the bottom end 40 of each leg member are parallel and are cut at an angle 36. The notch 24 is cut in a downward direction perpendicular with the top end 38. A hole 40 is drilled into each leg member for receiving pivot screw 26 (FIG. 2). The position and dimensions of notch 24 and pivot screw hole 40 are the same for each leg member.

Since each leg member has the same dimensions, the cost and time of manufacturing each saw horse is reduced. For example, multiple boards can be stacked on top of each other so that both leg member 20 and 22 can be cut at the same time. Thus, the same saw guide adjustments can be used for fabricating both leg member 20 and 22. Alternatively, if the leg members are made out of plastic, only one mold is required to make each leg assembly.

In one embodiment of the invention, each leg member is a wood board 3½ inches wide, ¾ inches thick and cut at the top and bottom ends at an angle 36 of approximately 73 degrees. This angle orients the notches at a complementary acute angle of 17 degrees relative to the long sides of the leg members. These angles are preferred but can be varied.

Figure 7:
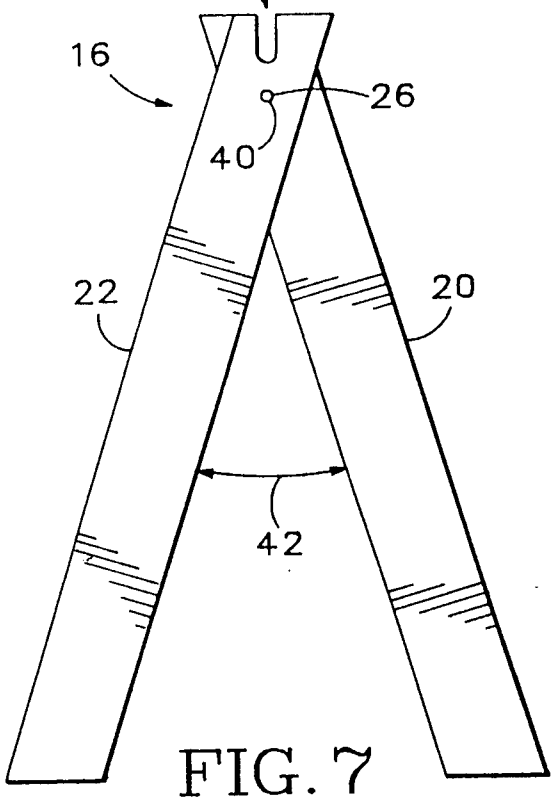
FIG. 7 is a front view of the leg assembly shown in FIG. 1 in an open position.

FIG. 7 is a front view of the leg assembly 16 shown in FIG. 1 in an attached open position ready for receiving support member 14. To assemble leg assembly 16, either leg member 20 or 22 is first inverted 180 degrees (e.g., FIG. 7 leg member 22 is shown inverted). The pivot screw holes 40 are then aligned and pivot screw 26 is inserted. To attach the leg assembly to support member 14, the leg members 20 and 22 are rotated until the notches at the top end align to form channel 30. The support member 14 (FIG. 5) is then inserted into channel 30. In the open position, as shown in FIG. 7, the leg members 20 and 22 incline away from each other at an angle 42. Angle 42 is adjusted by accordingly changing the cutting angle 36 (FIG. 6) at the top and bottom ends of each leg member.

Figure 8:
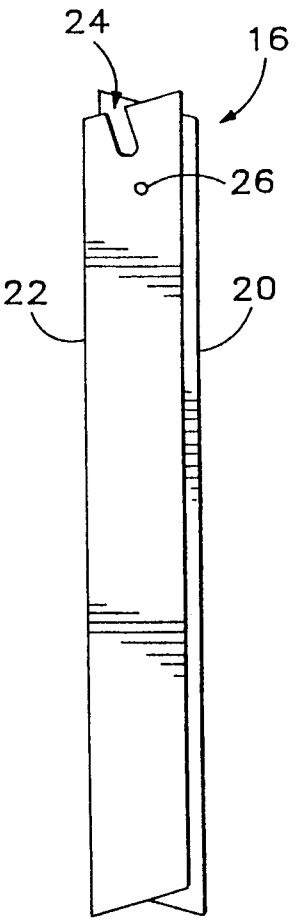
FIG. 8 is a front view of the leg assembly shown in FIG. 1 in a closed position.

FIG. 8 is a front view of the leg assembly 16 shown in FIG. 1 in a closed position. As described above, for transport and storage, the leg assembly 16 can be rotated about pivot screw 26 into the closed position shown in FIG. 8. The pivot screw 26 holds the leg members 20 and 22 together and make it easier to align the notches 24. Although, pivot screw 24 makes it easier to align the leg members into the open position shown in FIG. 7, it is not necessary for certain embodiments of the invention as described below.

Figure 9:
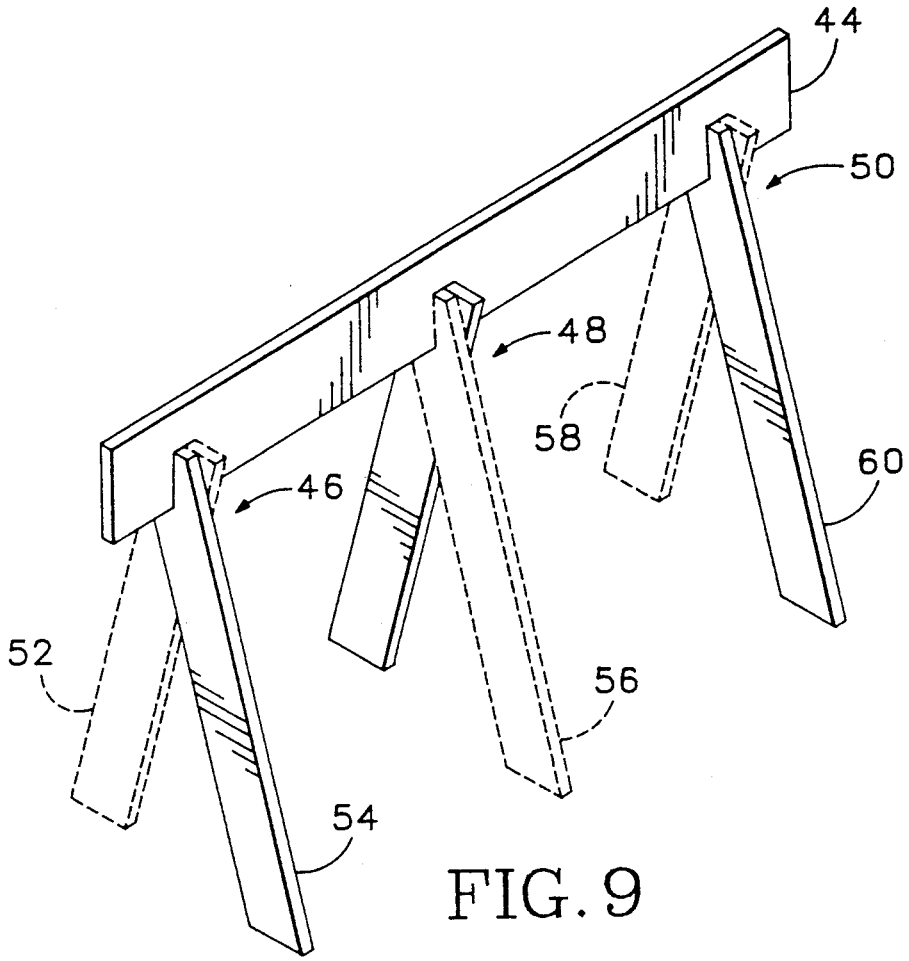
FIG. 9 is a perspective view of an alternative embodiment of the invention that uses three leg assemblies.

FIG. 9 is a perspective view of an alternative embodiment of the invention. A support member 44 engages with three leg assemblies 46, 48, and 50. Leg members 52, 56, and 58 are shown in phantom lines to illustrate alternative leg assembly configurations according to the invention.

For example, in one embodiment of the invention, support member 44 is longer than previously shown in FIG. 1. If required, an additional leg assembly 48 can be engaged underneath the center of the support member 44 to increase sawhorse load capacity. Alternatively, single leg members 52, 56 and 58 can be engaged with support member 44 in alternating directions. Thus, a support member of varying length can be used with any number of leg assemblies. In addition, each leg assembly can include either one or two leg members. The easy engagement of additional leg assemblies with support members of different lengths allow the sawhorse to be easily customized for specific applications, thus, further reducing costs. For example, one pair of sawhorses with longer support members can replace two pair of sawhorses placed side-by-side.

In one application of the invention, only leg assemblies are required to be manufactured. For example, a consumer would purchase the leg assemblies along with a set of instructions that describe how to make a support member. After the consumer has fabricated the support member, the instructions describe how to assemble and attach the leg assemblies to the fabricated support member. Thus, after a support member wears out, for example, after being cut repeatedly by a saw, another support member can be fabricated and used with the existing leg assemblies.

The leg assemblies and the support member can either be made from the same or different materials depending upon the application and other design considerations. The leg assemblies, typically, do not have to withstand the same abuse as the support member. For example, the support member is often accidentally cut at the same time that materials laid on top of the support member are being sawed. Thus, the support member can be made out of a soft wood that does not destroy saw blades while the leg assemblies can be made out of hardwood, plastic, or metal to extend operating life. Alternatively, both the support member and the legs assemblies can be made out of the same material, for example, either wood, plastic, or metal depending upon whether the sawhorse is being used solely as a support stand or as a support for cutting different materials.

Having described and illustrated the principles of the invention in a preferred embodiment thereof, it should be apparent that the invention can be modified in arrangement and detail without departing from such principles.

I claim all modifications and variation coming within the spirit and scope of the following claims:

1. A knock-down sawhorse for supporting various articles in a horizontal disposition, comprising:

an elongated, horizontally disposed support member having a top support side and a bottom side portion and first and second opposed lateral sides; and a first upright leg assembly and a second upright leg assembly spaced apart lengthwise along the support member of each assembly including a pair of separate, oppositely inclined elongate leg members that overlap at a top end thereof;

each leg member of each leg assembly having a notch at the top end thereof, the notch including a bottom wall and a pair of opposed sidewalls providing an open top entry sized to receive the bottom side portion of the support member;

the notches in the oppositely inclined leg members of each leg assembly being aligned to form a leg assembly channel wherein the first and second lateral sides of the support member are bindingly engaged.

2. The sawhorse according to claim 1 wherein the support member includes a pair of lengthwise spaced apart grooves in the bottom side portion, each groove associated with a leg assembly and engaging with said leg assembly channel.

3. The sawhorse according to claim 2 wherein the support member grooves are directed downward from the bottom end passing symmetrically through the first and second sides at oppositely inclining angles.

4. The sawhorse according to claim 1 wherein each leg assembly includes a pivot screw that pivotally couples the leg members together, the pivot screw positioned so that rotating the top end of each leg member into an open support member receiving position cause the notches to align forming the leg assembly channel.

5. The sawhorse according to claim 4 wherein the pivot screw is attached to each leg member aligned below the notches so that the support member after being inserted into the leg assembly channel sits over the pivot screw.

6. The sawhorse according to claim 1 wherein each leg member has a major cross-sectional dimension oriented perpendicular to the lateral sides of the support member.

7. The sawhorse according to claim 1 wherein the notches in the top end of the leg members each have parallel sidewalls spaced to slidingly receive the support member therebetween, wherein the leg members in each leg assembly pivot in opposite directions in a scissor-like fashion so that both opposite sidewalls of each notch coact to bindingly engage the lateral sides of the support member.

8. The sawhorse according to claim 1 wherein each leg member has a central longitudinal axis and a parallel top and bottom end each intersecting the central longitudinal axis at a predetermined acute angle, the notch of each leg member being oriented at said acute angle relative to the top end.

9. The sawhorse according to claim 1 wherein each leg member has the same dimensions and the notch associated with each leg member has the same dimensions, each notch located at the same relative location on the associated leg member.

10. A knock-down sawhorse, comprising:

a support member having first and second ends and a horizontally directed longitudinal axis; and at least two legs each having a longitudinal axis and a substantially U-shaped notch at a top end for receiving the support member;

the U-shaped notches of the two legs having a pair of opposed sidewalls angled in relation to said longitudinal axis so that said legs are mutually inclined at an acute angle about the longitudinal axis of the support member.

11. The sawhorse according to claim 10 wherein the support member includes a groove for engaging with the notch of said two legs, the groove having parallel inside faces that provide lateral support for said two legs.

12. The sawhorse according to claim 10 including a pin pivotally coupling two of the legs together and positioned so that the notches of the two legs can be rotationally aligned to form a single channel for receiving the support member.

13. The sawhorse according to claim 12 wherein the support member includes a groove for engaging with said channel, the groove having parallel inside walls that provide lateral support for keeping the legs vertically aligned.

* * * * *